US005586916A

United States Patent [19]

Shinji et al.

[11] Patent Number: 5,586,916

[45] Date of Patent: Dec. 24, 1996

[54] WATERPROOF COVER FOR CONNECTOR

[75] Inventors: Yasuhisa Shinji; Kazuhiro Morishita; Hiraji Takase, all of Shizuoka-ken, Japan

[73] Assignee: Yazaki Corporation, Tokyo, Japan

[21] Appl. No.: 415,986

[22] Filed: Apr. 4, 1995

[30] Foreign Application Priority Data

Apr. 15, 1994 [JP] Japan ..... 6-077257

[51] Int. Cl.[6] ..... H01R 13/514; H01R 13/56; H01R 13/58

[52] U.S. Cl. ..... 439/752; 439/448; 439/467

[58] Field of Search ..... 439/521, 587, 439/589, 592, 274, 275, 279, 752, 448, 467, 596

[56] References Cited

U.S. PATENT DOCUMENTS 5,435,758 7/1995 Sasai et al. ..... 439/752

FOREIGN PATENT DOCUMENTS 3-2570 1/1991 Japan .

*Primary Examiner*—Neil Abrams
*Assistant Examiner*—Yong Kim
*Attorney, Agent, or Firm*—Oblon, Spivak, McClelland, Maier & Neustadt, P.C.

[57] ABSTRACT

A waterproof cover for a connector includes a rear holder portion attached to a rear portion of a connector housing to hold terminals inserted into terminal insertion holes of the connector housing from a rear side of the connector housing; and a waterproof cover portion attached to a rear side of the rear holder portion to cover wires extending rearward from the terminals. The waterproof cover has a pair of first and second cover halves; a hinge for linking a pair of the first and second cover halves so as to be opened and closed relative to each other; and a lock mechanism for locking a pair of the first and second cover halves when the two cover halves are closed. In particular, a front end surface of the first cover half is formed integrally with an outer circumference of the rear holder portion so as to form an end surface plate of the first cover half along roughly all over the circumference of the first cover half. Therefore, even if the hinge is broken or damaged, the waterproof cover will not be removed from the rear holder portion.

9 Claims, 10 Drawing Sheets

WATERPROOF COVER FOR CONNECTOR

BACKGROUND OF THE INVENTION

1. Field of the Invention

The present invention relates to a waterproof cover used for a connector to prevent water from entering a connector housing through a wire lead-out portion thereof even if high pressure washing water is jetted thereto, and more specifically to a waterproof cover used for a connector in which a rear holder portion (for preventing terminals from being moved rearward from the connector housing) and a waterproof cover portion are both formed integral with each other.

2. Description of Related Art

An example of conventional connectors each provided with a waterproof cover is disclosed in Japanese Published Unexamined Utility Model Application No. 3-2570. In this conventional connector of waterproof structure, the connector is composed of a connector housing, a plurality of terminals each connected to a wire together with a rubber waterproof plug, and a waterproof cover including a rear holder portion and a waterproof cover portion. In more detail, an end of the wire is connected to a rear end of the terminal, and the rubber waterproof plug is fitted to the outer circumference of the wire connected to the terminal. On the other hand, the connector housing is formed with a plurality of terminal insertion holes and some engage recessed portions and some engage holes. Therefore, the terminals having the wire and the waterproof plug are inserted into the terminal insertion holes, respectively. The rear holder portion of the waterproof cover serves to push the terminals frontward via the waterproof plugs, respectively; that is, to prevent the terminals and the waterproof plugs from being removed from the connector housing. The rear holder portion of the waterproof cover is a thick-wall square-shaped base plate formed with a few slits for leading out the wires and having some engaging projection portions engaged with the engage recessed portions of the connector housing and lock projections locked with the lock holes thereof, respectively. On the other hand, the waterproof cover portion is formed into a cylindrical shape and split into two cover halves so that the wires can be covered. These two split cover halves are connected to an upper end edge and a lower end edge of the rear holder portions via two hinges, respectively so as to be opened and closed relative to each other. Further, a lock mechanism is provided on the outer surface of the two cover halves to lock the two closed cover halves. In addition, the water cover portion is formed with a rear wire lead-out hole at the rear end thereof.

To attach the waterproof cover (composed of the rear holder portion and the waterproof cover portion) to the connector housing so as to cover the wires under a waterproof condition, first the lock projections of the rear holder portion are engaged with the lock holes of the connector housing so that the engage projection portions of the rear holder portion can be engaged with the engage recessed portions of the connector housing. Under these conditions, the waterproof plugs fitted to the wires, respectively can be urged toward the connector housing by the attached waterproof cover. After that, the wires led out of the splits formed in the rear holder portion are taken out through the wire lead out hole of the waterproof cover portion and then the two cover halves are closed and further locked by the lock mechanism. Under these conditions, since the wire lead out portion can be protected by the waterproof cover portion, even if high pressure washing water is directly jetted against the connector, it is possible to prevent water from entering the connector housing.

Further, there exists another conventional waterproof cover, which is composed of an oval-shaped rear holder portion formed with a single slit and a waterproof cover portion made up of two cover halves. These two cover halves are also connected to the side edges of the rear holder portion via hinge portions so as to be opened and closed with respect to each other.

In assembly, the rear holder portion is attached to the connector housing with the use of some lock projections and lock holes, and further the two cover halves are closed and locked with the use of a lock mechanism. Further, in tills example, a corrugated tube fitted to the wires is sandwiched between the two closed cover halves for waterproof.

In the above-mentioned two conventional waterproof covers, however, since the structure is such that the rear holder portion and the waterproof cover portion are connected to each other through hinges, there exists a problem in that the hinges are easily broken off during maintenance so that the waterproof cover portion is easily removed from the connector. In addition, during disassembly of the connector, since the two cover halves must be first unlocked and then the rear holder portion must be further unlocked (i.e. a double unlocking operation), a problem arises in that the disassembly work is troublesome and therefore it takes much time.

SUMMARY OF THE INVENTION

With these problems in mind, therefore, it is the object of the present invention to provide a waterproof cover for a connector, which can prevent the waterproof cover portion from being removed from the rear holder portion even if the hinge portion thereof is damaged and which further can simplify the unlocking operation when the waterproof cover is required to be removed from the connector housing.

To achieve the above-mentioned object, the present invention provides a waterproof cover (M, MA) for a connector, which comprises: a rear holder portion (65, 165) attached to a rear portion of a connector housing (51) to hold terminals (T) inserted into terminal insertion holes (52) of the connector housing from a rear side of the connector housing; and a waterproof cover portion (80, 180) attached to a rear side of said rear holder portion to cover wires (W) extending rearward from the terminals, said waterproof cover portion having: a pair of first and second cover halves (81, 82), a front end surface of said first cover half (81) being formed integral with an outer circumference of said rear holer portion (65, 165) so as to form an end surface plate of said first cover half (81) along roughly all over the circumference of said first cover half; a hinge (85) for linking a pair of said first and second cover halves so as to be opened and closed relative to each other; and a lock mechanism (89, 91) for locking a pair of said first and second cover halves when said two cover halves are closed.

Further, the first cover half (81) is further formed with a pair of extension walls (84*a*, 84*c*) at two joint portions (92, 93) between said two closed cover halves so as to extend outward and receive said second cover half between the two extension walls.

Further, at least one lock recessed portion (89) constituting said lock mechanism is formed on an inner side surface of each of the two extension walls (84*a*, 84*c*) of said first cover half (81). In addition, at least one lock projection porion (91) constituting said lock mechanism in cooperation with the lock recessed portion (89) is formed on an outer side surface of each of two side walls (90*a*, 90*c*) of said second cover half (82). Moreover, at least one lock release jig insertion hole (95) for unlocking said lock mechanism (89, 91) is formed on a base portion of each of the two extension walls (84*a*, 84*c*) of said first cover half (81).

Further, the hinge (85) is a thin resin plate formed integral with a pair of said first and second cover halves (81, 82), two ends of said hinge being joined perpendicularly with two outer side surfaces of said first and second cover halves, respectively at a position a distanced from the two joint portions (92, 93) between said two closed cover halves.

Further, the rear holder portion (65) is formed into such a size as to be engaged with a rear outer engage frame (51*a*) of the connector housing (51) and formed with a plurality of first lock projections (68) on one side thereof and a plurality of second lock projections (72) on the other side thereof, the first and second lock projections being engaged with engaging holes (54) formed in the rear outer engage frame (51*a*) of the connector housing (51) when said rear holder portion is attached to the connector housing.

Further, the rear holder portion (165) is formed into such a size as to be engaged with a rear outer engage frame (51*a*) of the connector housing (51) and formed with a plurality of first lock holes (166) on a first side thereof; said second cover half (82) is formed with a projection wall (181) extending frontward on the same first side so as to cover the rear outer engage frame (51*a*); and a plurality of lock projections (182) are formed in an inner surface of the projection wall (181); when said second cover half is closed to said first cover half (81), the lock projections (182) being passed through engaging holes (54) formed in the rear outer engage frame (51*a*) and further engaged with lock holes (166) formed in the said rear holder portion (165) to attach said rear holder portion to the connector housing.

Further, the first and second cover halves (81, 82) are formed with a corrugate tube fitting groove (88) on a rear end portion thereof, respectively.

In the waterproof cover for a connector according to the present invention, since the rear holder portion is directly formed integral with one of the two cover halves of the waterproof cover portion without use of any hinge, it is possible to increase the rigidity of one of the cover halves and further the joint strength between the rear holder portion and the cover half. Further, two cover halves can be locked with each other by a lock mechanism, even if the hinge is broken or damaged during maintenance, it is possible to prevent the rear holder portion from being removed from the waterproof cover portion. Further, even if a wire extracting force is applied to the waterproof cover, since the force can be received by the lock mechanism without being applied to the hinge, it is possible to improve the durability of the hinge, that is, the life time of the waterproof cover.

Further, since the second (lid side) cover half can be held between the two extension walls of the first (base side) cover half, the unity (i.e., the rigidity) of the two cover halves can be increased under the closed condition. Also, the locking force of the cover halves can be increased. Further, the corrugated tube can be supported by the two cover halves stably. In addition, since the cover half lock mechanism is provided Inside the extension walls, it is possible to prevent the lock mechanism from being released inadvertently. That is, the lock mechanism can be released by use of only a lock releasing jig.

Further, since only a small force is applied to the hinge, the life time of the hinge can be increased without being damaged easily.

DESCRIPTION OF THE PREFERRED EMBODIMENTS

Embodiments of the waterproof cover for a connector according to the present invention will be described in detail hereinbelow with reference to the attached drawings.

A first embodiment thereof will be described with reference to FIGS. 1 to 9.

Figure 1:
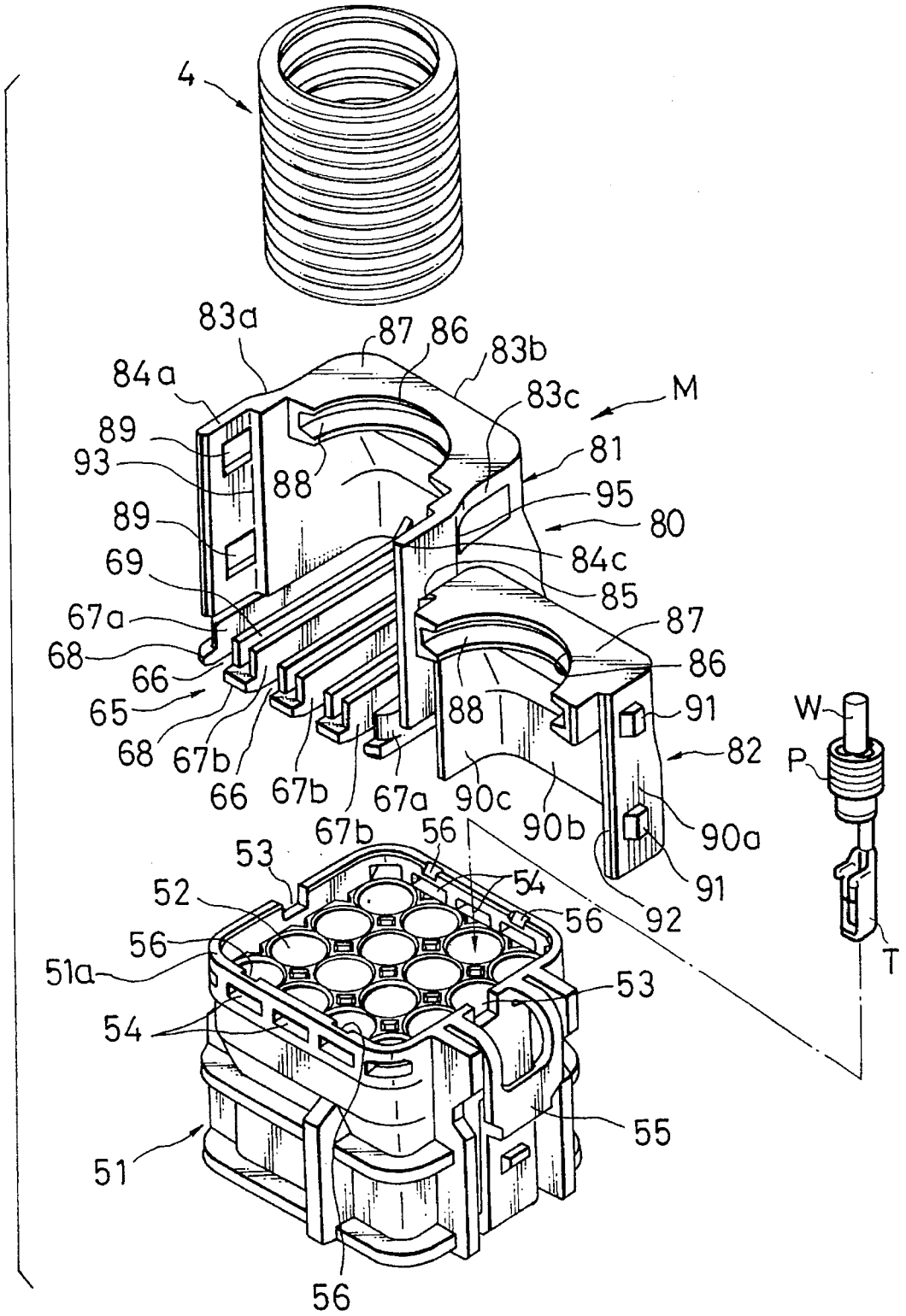
FIG. 1 is a perspective exploded view showing a first embodiment of the waterproof cover for a connector according to the present invention, in which the waterproof cover is not yet assembled with the connector housing.

In FIG. 1, the waterproof cover M is attached to a connector housing 51. The waterproof cover M is roughly composed of a rear holder portion 65 and a cylindrical waterproof cover portion 80. Further, the cylindrical waterproof cover portion 80 is further composed of a pair of cover halves 81 and 82 connected by a hinge 85 therebetween. In addition, the waterproof cover M includes a pair of lock mechanisms having lock recessed portions 89 and lock projection portions 91 for locking the two waterproof cover halves 81 and 82, and a corrugated tube 4 sandwiched between the two closed cover halves 81 and 82.

One of the features of the waterproof cover M according to the present invention is that the rear holder portion 65 is formed integrally with the cover half 81 of the waterproof cover 80.

In more detail, the connector housing 51 is formed into a box-shaped (rectangular parallelepiped-shaped) and formed with a plurality of terminal insertion holes 52 into each of which each terminal is inserted from the rear end opening side thereof (from above in FIG. 1). The connector housing 51 is further formed with a square rear outer engage frame 51*a* at the rear end of the connector housing 51 in such a way that the circumferential edge of the rear holder portion 65 of the waterproof cover M can be fitted thereto. Further, a pair of recessed portions 53 are formed on one of the two opposing sides of the engage frame 51*a*, and a number (five) of rectangular engage holes 54 (See FIG. 4) are formed on the other of the two opposing sides of the engage frame 51*a* along the outer circumference thereof, respectively. Further, a lock arm 55 is formed in an outer surface of the connector housing 51 so as to be locked with a mated connector housing (not shown). In addition, four guide slope surfaces 56 are formed in an inner edge portion of the engage frame 51*a* so that two lock projections 72 (See FIG. 2) can be guided, respectively when the lock projections 72 are pressure fitted into the engage holes 54.

As shown in FIGS. 1 to 3D, the waterproof cover M is composed of the rear holder portion 65 and the waterproof cover portion 80 both formed of a resin integral with each other. When attached to the rear end (the upper side in FIG. 1) of the connector housing 51, the rear holder portion 65 serves to prevent a plurality of rubber waterproof plugs P each fitted to an outer circumferential surface of a wire W (connected to a terminal T) from being moved in the rearward direction of the connector housing 51. Therefore, the size of the rear holder portion 65 is formed into such a size as to be fitted to the rear outer engage frame 51*a* formed the rear end of the connector housing 51.

The waterproof cover portion 80 serves to cover the wires W led out of the connector housing 51, which is formed into a square cylindrical shape and composed of a pair of first and second U-shaped cross-section cover halves 81 and 82. Here, the first cover half 81 is referred to as a body side cover half, and the second cover half 82 is referred to as a lid side cover half.

Figure 2:
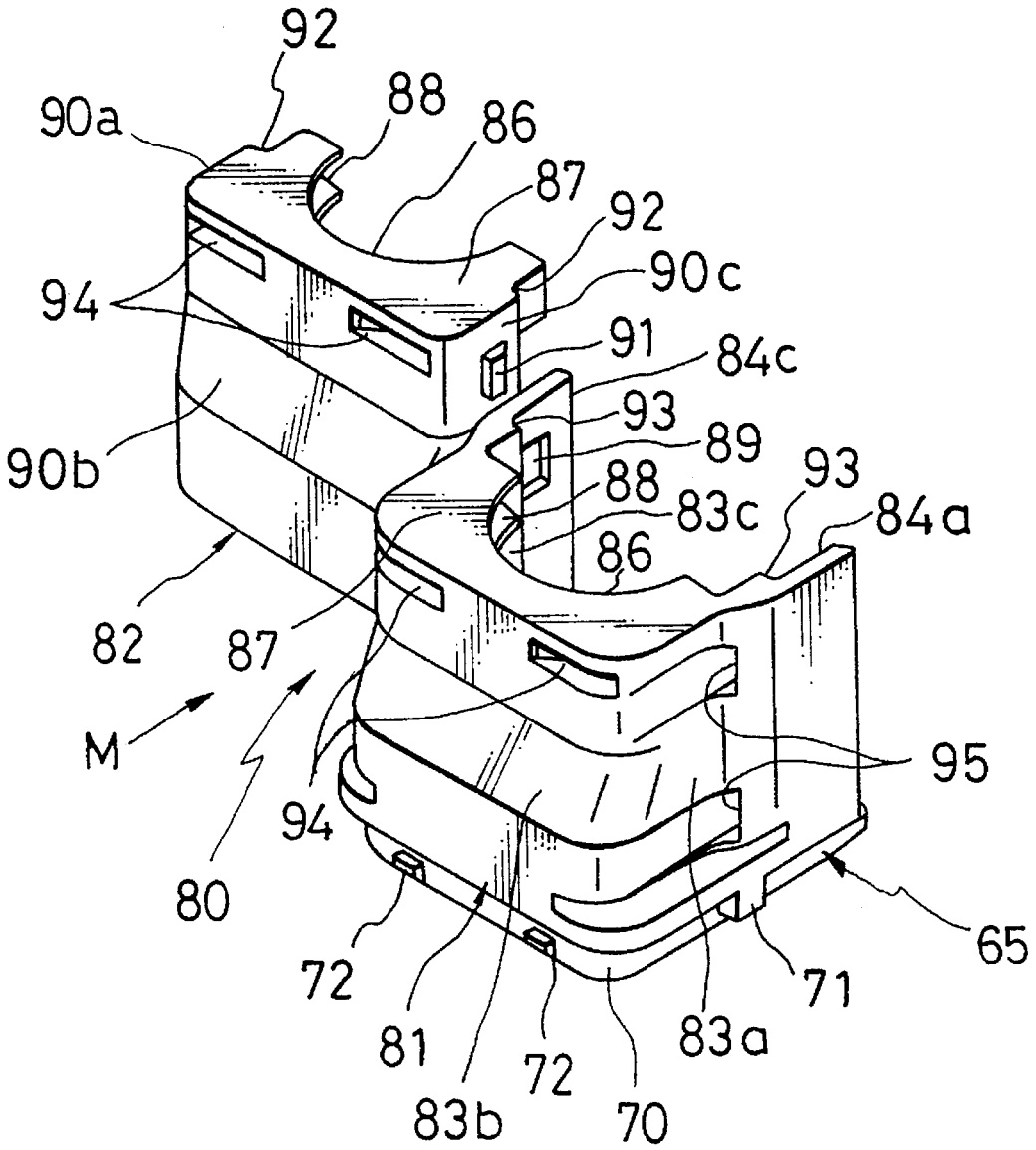
FIG. 2 is a perspective view showing the first embodiment of the waterproof cover for a connector according to the present invention, when seen from another direction.

In FIG. 2, the body side cover half 81 is formed with a right side wall 83*a*, a middle side wall 83*b* and a left side wall 83*c* and additionally with two extension walls 84*a* and 84*c* extending outward from each of the right and left side walls 83*a* and 83*c*, respectively. Further, as shown in FIG. 1, the rear holder portion 65 is formed integrally with an end of the body side cover half 81, as an end plate of the body side cover half 81, on the front side (on the connector housing side) thereof. In other words, all the front outer end edges of the body side cover half 81 (i.e., the right side wall 83*a*, the middle side wall 83*b* and the left side wall 83*c*) are connected integrally with the circumferential edge of the rear holder portion 65.

The rear holder portion 65 formed as an end plate of the body side cover half 81 is formed with a plurality of comb-shaped wire push portions 67*a* and 67*b* extending from the middle side wall 83*b* of the body side cover half 81 along the right and left side walls 83*a* and 83*c*, and thereby a plurality of slits 66 (four in FIG. 1) can be formed. The wires W extending from the terminals T are passed through these slits 66. The number of the slits 66 corresponds to the number of columns of the wire insertion holes 52 formed in the connector housing 51. Therefore, the wire push portions 67*a* and 67*b* are to be located between the two adjacent rows of the wires so as to be brought into tight contact with the outer circumferential surfaces of the waterproof plugs P.

Figure 3A:
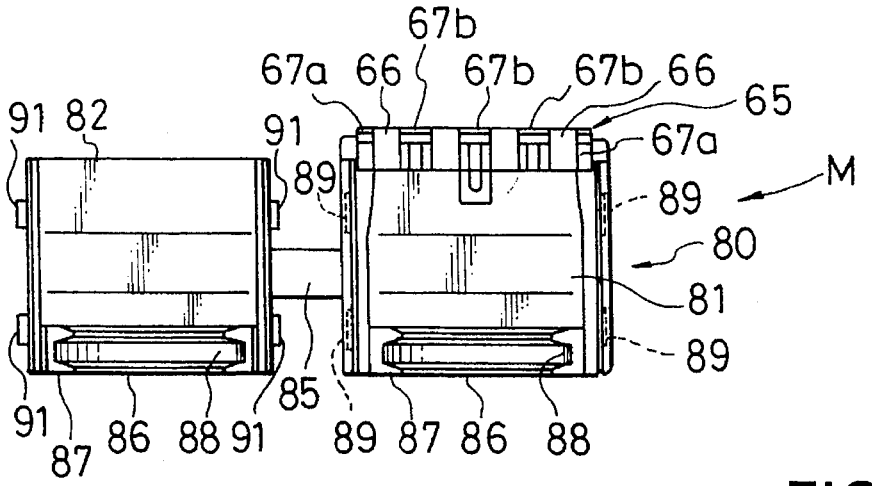
FIG. 3A is a development plan view showing the first embodiment of the waterproof cover for a connector.
Figure 3B:
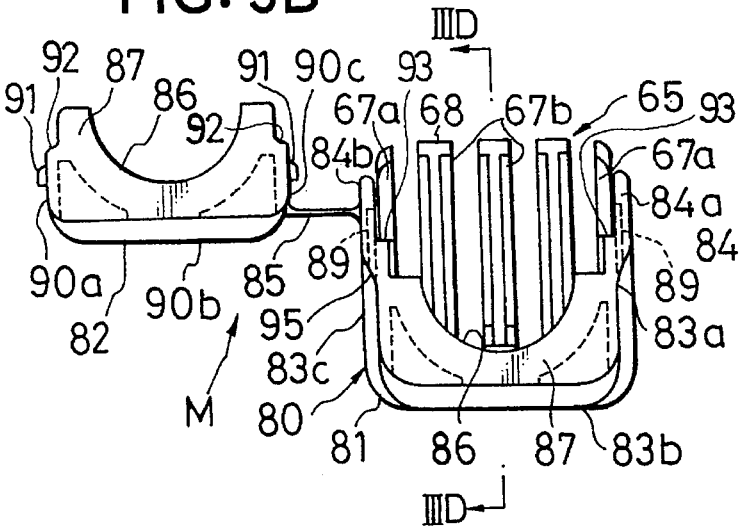
FIG. 3B is a development plan view showing the first embodiment of the waterproof cover for a connector.
Figure 3C:
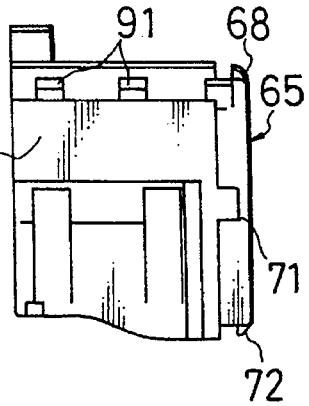
FIG. 3C is a development side view showing the first embodiment of the waterproof cover for a connector.
Figure 3D:
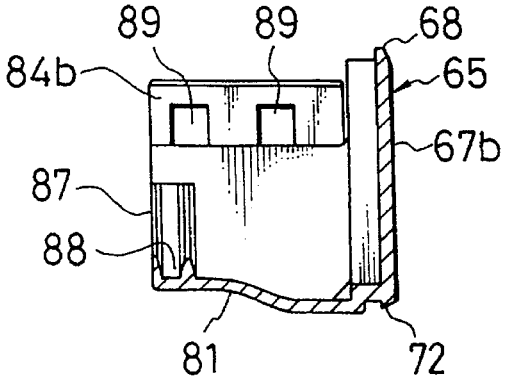
FIG. 3D is a development cross-sectional view taken along the line IIID—IIID in FIG. 3B.
Figure 4:
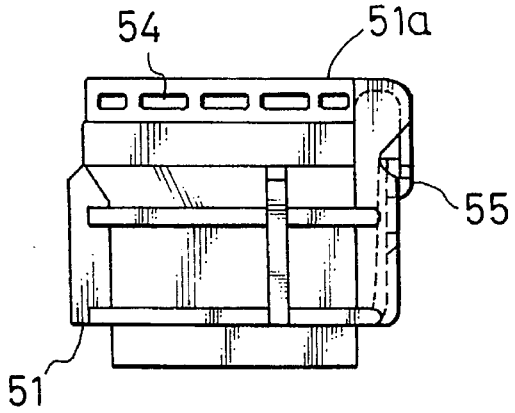
FIG. 4 is a side view showing a connector to which the first embodiment of the waterproof plug for a connector is to be attached.

At each end of the wire push portions 67*a* and 67*b*, a lock projection 68 is formed so as to be engaged with each of the engaging holes 54 formed in the connector housing 51. Further, a wall-thickness adjusting groove 69 is formed between two opposing inner surfaces of each of the three wire push portions 67*b* (other than those arranged on both sides). Further, as shown in FIG. 2, two engaging projection portions 71 engaged with the engage recessed portions 53 formed at the engage frame 51*a* of the connector housing 51 and two lock projections 72 pressure fitted into the engaging holes 54 along the guide slop surfaces 56 also formed at the engaging frame 51*a* of the connector housing 51 are formed at the outer circumferential surface 70 of the rear holder portion 65. Here, the lock projections 68 and the lock projections 72 are formed so as to be located at two opposing end sides of the rear holder portion 65, as shown in FIGS. 3C and 3D.

Further, in FIG. 1, an end wall 87 having a wire harness lead-out hole 86 is formed integral with the end edge of the body side cover half 81 on the side opposite to the rear holder portion 65. The wire harness lead-out hole 86 is formed with an engaging groove 88 at the inner circumferential surface thereof so that one of the annular projections of the corrugated tube 4 can be fitted thereto. This end wall 87 is also split into two halves in such a way that one is formed integrally with the body side cover half 81 and the other is formed integrally with the lid side cover half 82, respectively.

Figure 6:
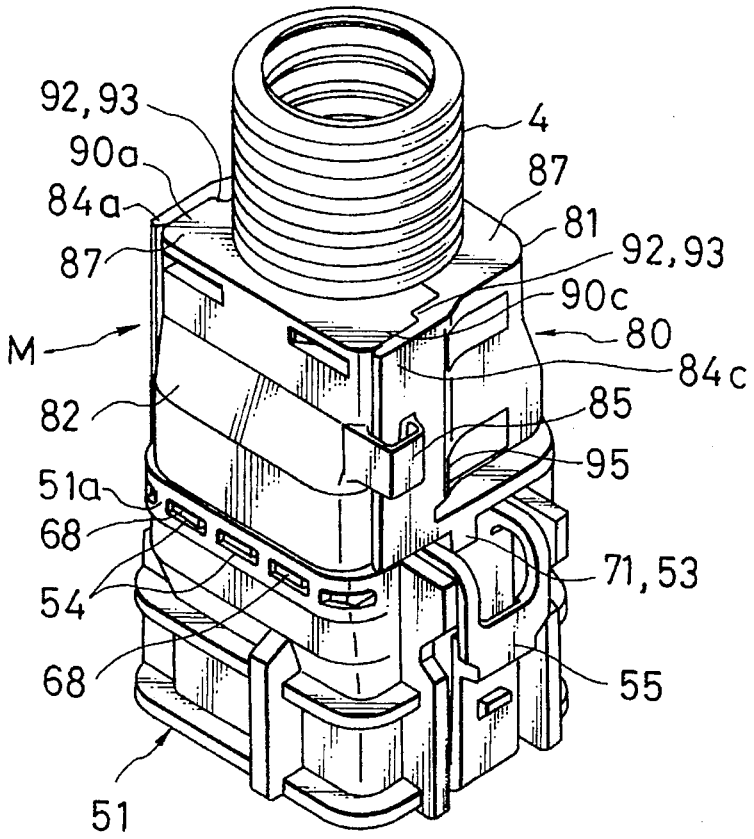
FIG. 6 is a perspective view showing the status where the first embodiment of the waterproof cover for a connector is attached to the connector housing and further a corrugated tube is sandwiched between two cover halves.
Figure 7:
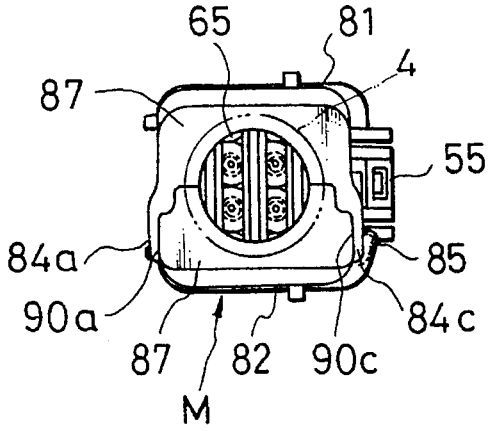
FIG. 7 is a rear view showing the same status where the first embodiment of the waterproof cover for a connector is attached to the connector housing, when seen from the corrugated tube side.
Figure 8:
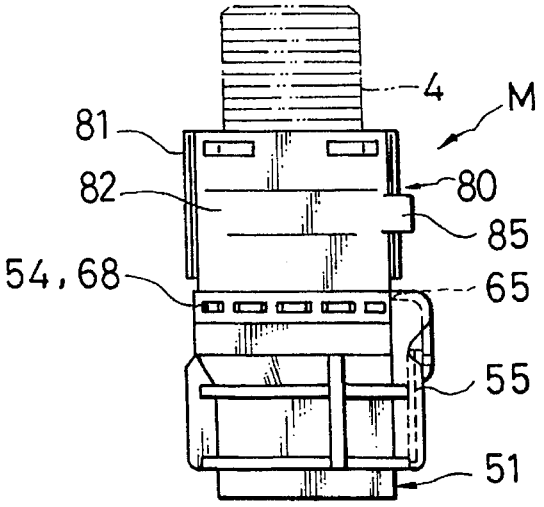
FIG. 8 is a side view showing the same status where the first embodiment of the waterproof cover for a connector is attached to the connector housing, when seen from the side.
Figure 9:
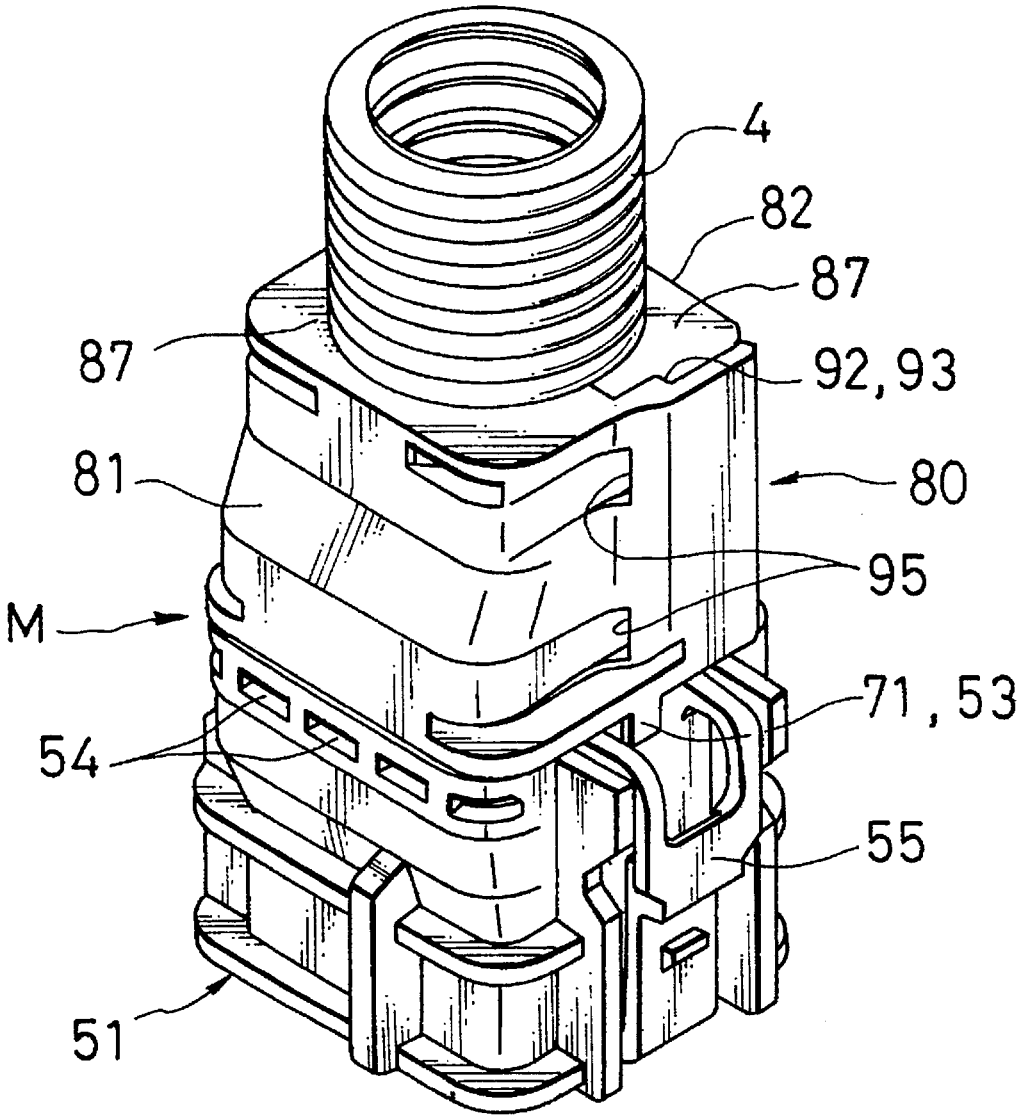
FIG. 9 is a perspective view showing the status where the first embodiment of the waterproof cover for a connector is attached to the connector housing and further a corrugated tube is sandwiched between two cover halves, which is seen from a side opposite to that shown in FIG. 6.
Figure 10:
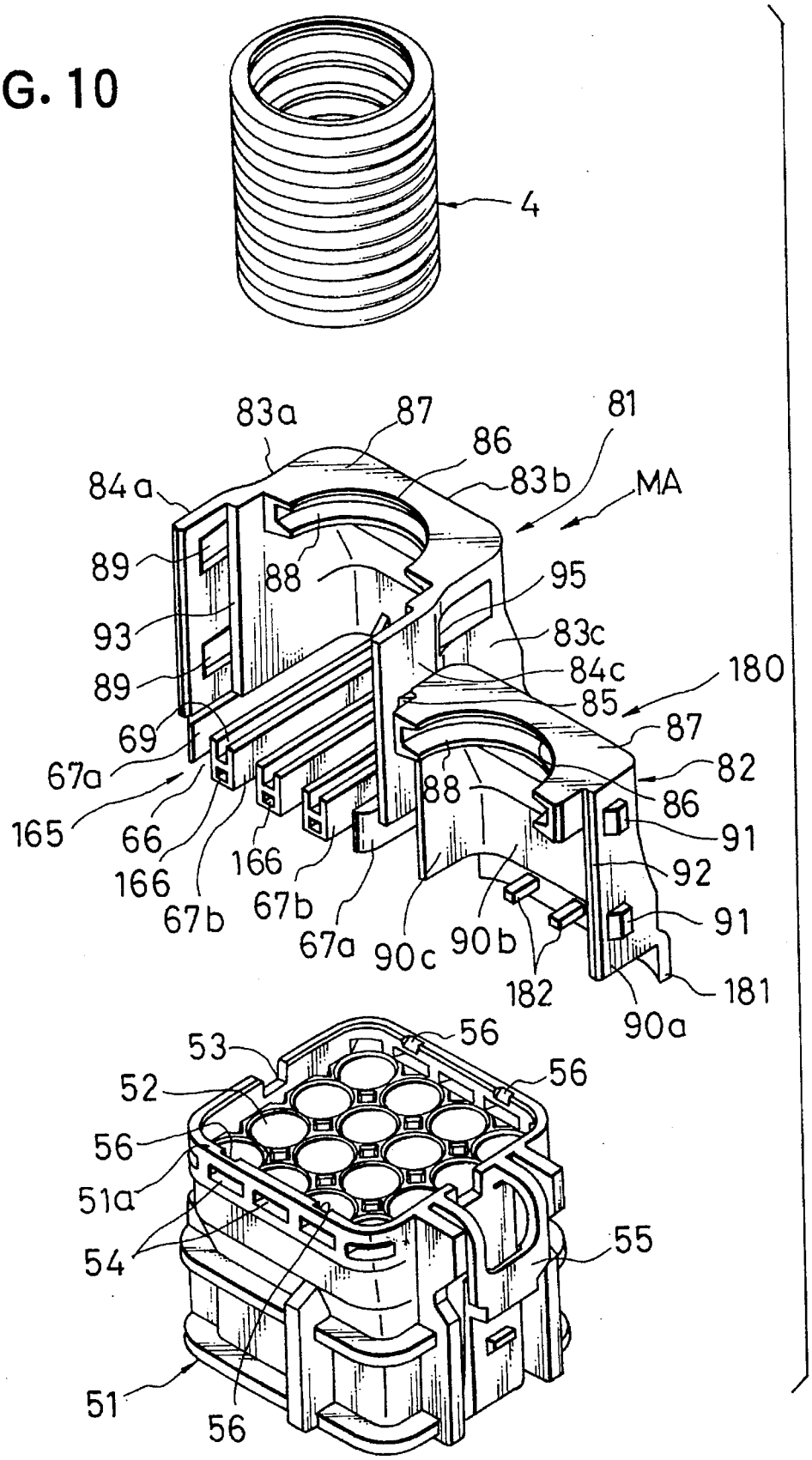
FIG. 10 is a perspective exploded view showing a second embodiment of the waterproof cover for a connector according to the present Invention, in which the waterproof cover is not yet assembled with the connector housing.
Figure 11A:
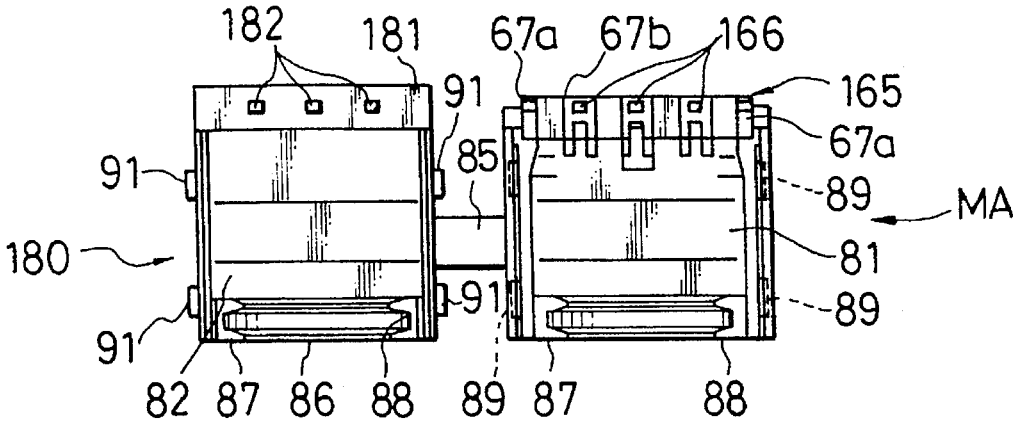
FIG. 11A is a development plan view showing the second embodiment of the waterproof cover for a connector.
Figure 11B:
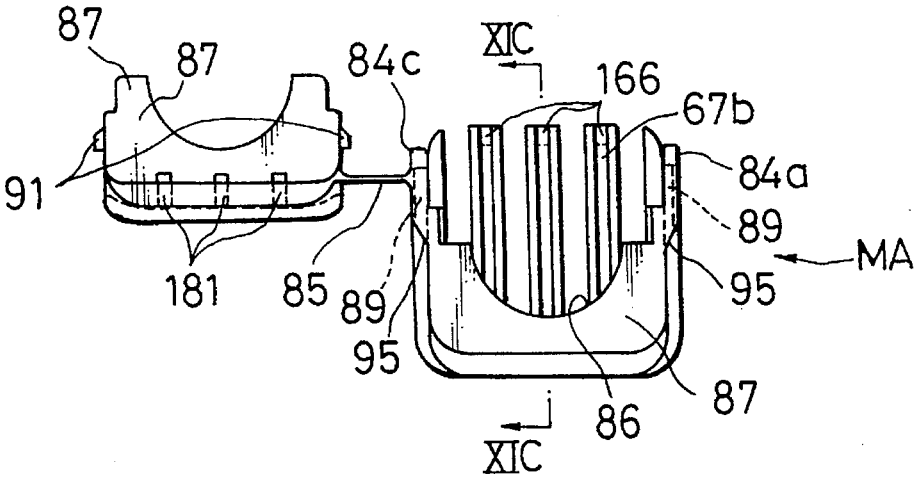
FIG. 11B is a development plan view showing the second embodiment of the waterproof cover for a connector.
Figure 11C:
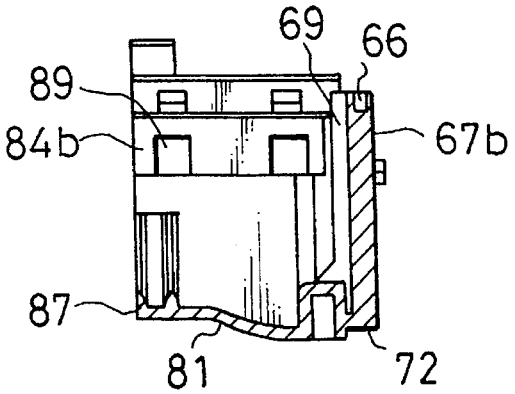
FIG. 11C is a development cross-sectional view taken along the line XIC—XIC in FIG. 11B.
Figure 12:
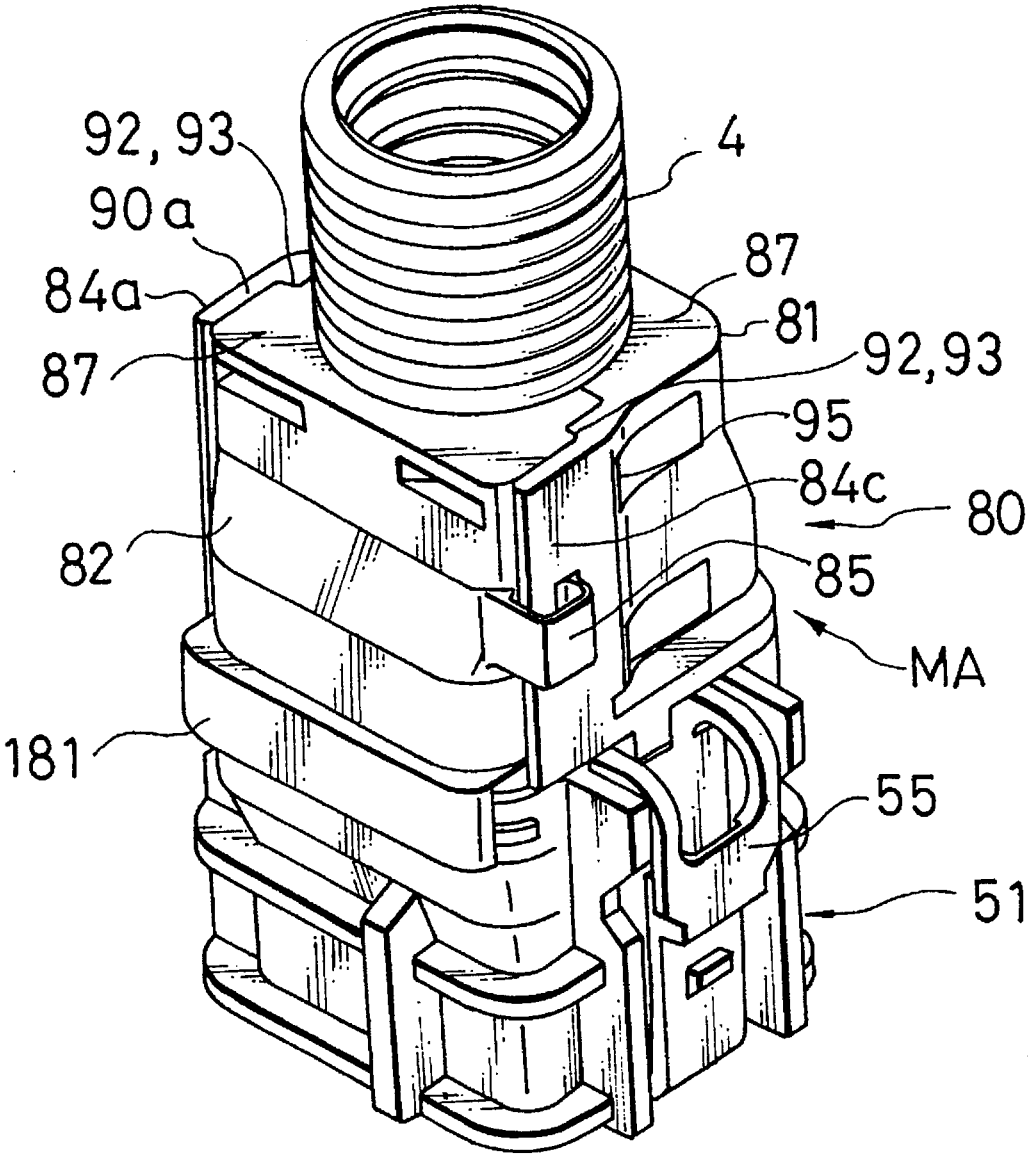
FIG. 12 is a perspective view showing the status where the second embodiment of the waterproof cover for a connector is attached to the connector housing and further a corrugated tube is sandwiched between two cover halves.
Figure 13:
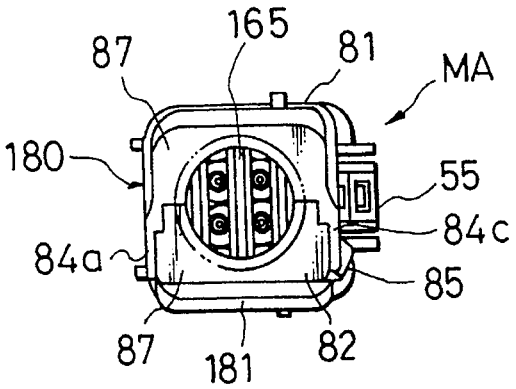
FIG. 13 is a rear view showing the same status where the second embodiment of the waterproof cover for a connector is attached to the connector housing, when seen from the corrugated tube side.
Figure 14:
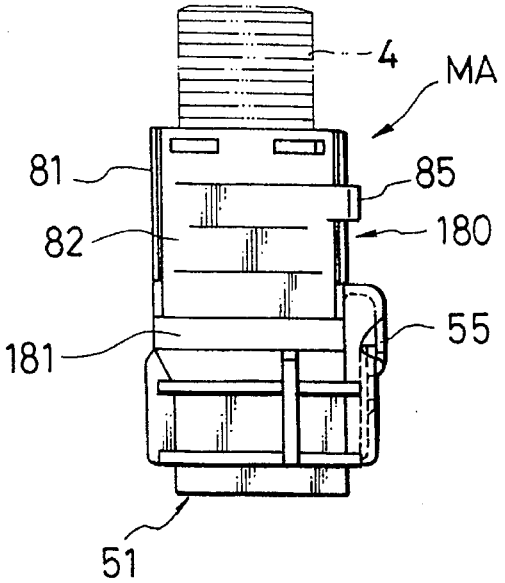
FIG. 14 is a side view showing the same status where the second embodiment of the waterproof cover for a connector is attached to the connector housing, when seen from the side.

In FIG. 2, the lid side cover half 82 is also composed of a right side wall 90*a*, a middle side wall 90*b* and a left side wall 90*c*, and connected to the body side cover half 81 via a hinge 85. Therefore, the lid side cover half 82 can be opened and closed relative to the body side cover half 81. As shown in FIGS. 3A and 3B, the hinge 85 is a thin-wall band plate formed integral with the two cover halves 81 and 82 on both ends thereof, respectively. Both ends of the hinge 85 are integrally formed with and are joined roughly perpendicularly to the outer side surfaces of the two left side walls 83*c* and 90*c* of the two cover halves 81 and 82, respectively. Further, as depicted in FIGS. 3B and 6, the hinge 85 is joined to the two cover halves 81 and 82 at such a position as to be spaced a distance away from joint portions 92 and 93 between the two cover halves 81 and 82 (the upper side joint surfaces 92 and 93 between the two right side walls 83*a* and 90*a* and between the two left side walls 83*c* and 90*c* in FIG. 3B).

The two extension walls 84*a* and 84*c* of the body side cover half 81 are formed so as to extend outward from the joint portions 92 and 93 of the cover half 81 toward the lid side cover half 82, so that the lid side cover half 82 can be received between the two extension walls 84*a* and 84*c* of the body side cover half 81. Further, two lock recessed portions 89 (See FIG. 1) are formed in an inner surface of each of the extension walls 84*a* and 84*c* of the body side cover half 81 being arranged in the longitudinal direction thereof. Further, two lock projection portions 91 (See FIG. 1) are formed on an outer surface of each of the right and left side walls 90*a* and 90*c* of the lid side cover half 82 being arranged in the longitudinal direction thereof. When the two cover halves 81 and 82 are closed, these lock projection portions 91 are engaged with these lock recessed portions 89, respectively. Further, two lock release jig insertion holes 95 communicating with the lock recessed portions 89 from the outside are formed at the two base end portions of the extension walls 84*a* and 84*c* of the body side cover half 81 respectively, so that a jig for releasing the lock between the lock projection portion 91 and the lock recessed portion 89 can be inserted therethrough. Further, In FIG. 2, two recessed portions 94 are provided to adjust the wall thickness (bending force) of the lid side cover half 82.

The function of the above-mentioned waterproof cover for a connector will now be described.

Figure 5:
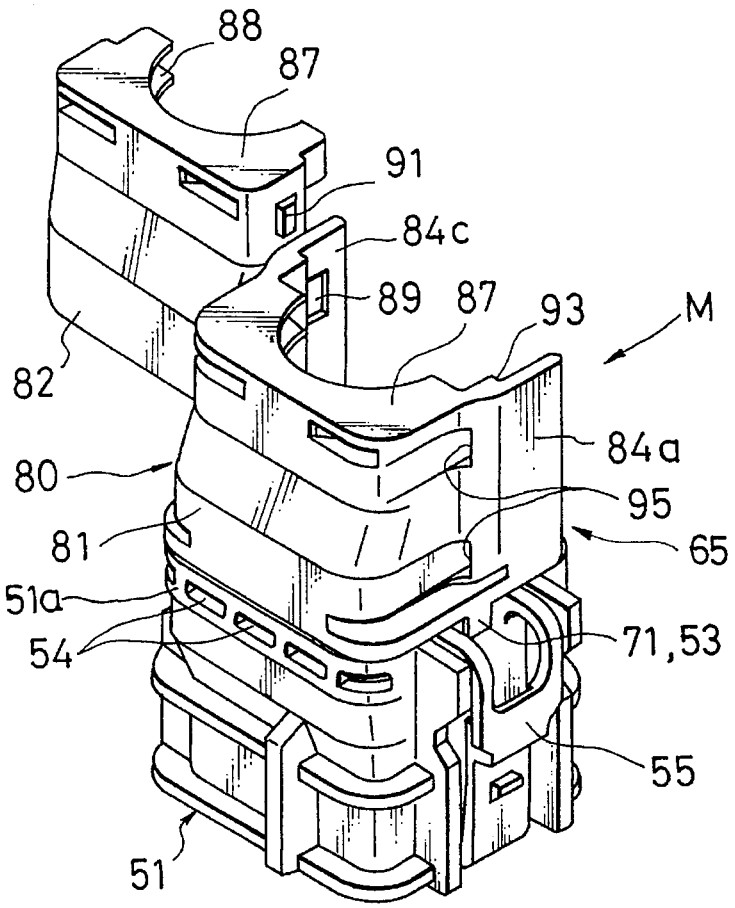
FIG. 5 is a perspective view showing the status where the first embodiment of the waterproof cover for a connector is attached to the connector housing.

To assemble the waterproof cover M with the connector housing 51, as shown in FIG. 5, the rear holder portion 65 of the front end of the waterproof cover M is attached to the connector housing 51. In more detail, the lock projections 68 formed in the wire push portions 67*a* and 67*b* of the rear holder portion 65 (See FIG. 1) are inserted into the engaging holes 54 of the connector housing 51, and further the lock projections 72 (See FIG. 2) formed on the opposite side of the rear holder portion 65 are pushed against the guide slope portions 56 (See FIG. 1) of the connector housing 51. Then, the rear holder portion 65 can be fitted to the engage frame 51*a* connector housing 51.

Successively, an annular recessed portion (the second or third groove from the lower end in FIG. 1) of the corrugated tube 4 is fitted to the engage groove 88 formed at the rear end of the body side cover half 81. Under these conditions, the lid side cover half 82 is closed to the body side cover half 81 and between the two extension walls 84*a* and 84*c*. Then, since the lock projection portions 91 of the lid side cover half 82 are engaged with the lock recessed portions 89 formed in the inner surface of the extension walls 84*a* and 84*c*, both the cover halves 81 and 82 can be locked with each other.

In the waterproof cover M of the present invention, since the rear holder portion 65 and the waterproof cover portion 80 are both molded together of a resin, only a single molding die is used. Further, since the body side cover half 81 is formed integrally with the rear holder portion 65 without the use of any hinge, it is possible to increase the junction strength between the rear holder portion 65 and the body side cover half 81. In particular, since the rear holder portion 65 serves as an end surface of the body side cover half 81, it is possible to increase the rigidity of the body side cover half 81 itself.

Further, since the two cover halves 81 and 82 are locked with each other by the lock mechanism (the lock recessed portions 89 and the lock projection portions 91), even if the hinge 85 is broken or damaged, it is possible to prevent the waterproof cover portion 80 from being removed from the waterproof cover M. Further, since even if a tension is applied to the waterproof cover portion 80 through the wires in the outward (wire extracting) direction, since the tension can be received by the lock mechanism (89 and 91), almost no tension is applied directly to the hinge 85, so that it is possible to improve the durability of the hinge 85.

Further, since the lid side cover half 82 is located on the inside surfaces of both the two extension walls 84*a* and 84*c* of the body side cover half 81 and additionally both the cover halves 81 and 82 are locked with each other under these conditions, it is possible to increase the unity of the waterproof cover portion 80 and thereby to improve the rigidity thereof, so that the waterproof cover portion 80 is difficult to be deformed and thereby the lock mechanism (89 and 91) is also difficult to be released. In addition, since the two extension walls 84*a* and 84*b* are present, when the corrugated tube 4 is fitted to the body side cover half 81, it is possible to hold the corrugated tube 4 stably, so that the assembly work can be simplified. Since, since the lock mechanism (89 and 91) of both the cover halves 81 and 82 are hidden inside the two extension walls 84*a* and 84*c*, it is possible to prevent the lock mechanism from being released inadvertently.

Since, since the lock mechanism (89 and 91) is provided on both right and left side walls of the two cover halves 81 and 82, respectively; that is, the lock mechanism is provided also near the hinge 85 connecting both the cover halves 81 and 82, even if a wire extracting force is applied to the waterproof cover M, it is possible to reduce the force applied to the hinge 85. Moreover, since the length of the hinge 85 is relatively long, the bending rate of the hinge required when the two cover halves 81 and 82 are closed is relatively small, so that the durability of the hinge 85 can be improved. Additionally, since the rear holder portion 65 is locked with the connector housing 51 on both sides thereof, it is possible to hold the waterproof cover M more firmly to the connector housing 51. Since, since the waterproof cover portion 80 is formed with a corrugated tube fitting groove 88, whenever the two cover halves 81 and 82 are closed, it is possible to prevent the corrugated tube 4 from being removed.

To disassembly the waterproof cover M from the connector housing 51, a lock release jig is inserted into the lock release jig insertion hole 95 formed at each base portion of the extension wall 84*a* or 84*d* of the body side cover half 81, to release one of the lock projection portions 91 from one of the lock recessed portions 89 by pushing it inward. When the lock condition of the two cover halves 81 and 82 of the waterproof cover portion 80 is released, the lid side cover half 82 can be opened from the body side cover half 81. After the lid side cover half 82 has been opened, the lock projections 72 (See FIG. 2) of the rear holder portion 65 are released from the engaging holes 54 formed in the connector housing 51 to remove the waterproof cover M from the connector housing 51.

A second embodiment of the waterproof cover according to the present invention will be described hereinbelow with reference to FIGS. 10 to 16.

In the same manner as with the case of the first embodiment, the waterproof cover MA is composed of a rear holder portion 165 and a waterproof cover portion 180. In the rear holder portion 165, however, a lock hole 166 is formed in each end surface of the wire push portions 67*b* of the rear holder portion 165 in such a way that the positions of the lock holes 166 match the position of the engaging hole 54 formed in the connector housing 51 when the rear holder portion 165 is fitted to the connector housing 51, instead of the lock projections 68 (See FIG. 1) inserted into the engage holes 54 of the connector housing 51 of the first embodiment. Further, the lid side cover half 82 is formed with a projection wall 181 extending frontward (downward in FIG. 10) so as to cover the outside of the engage frame 51*a* of the connector housing 51. Further, on the inner surface of this projection wall 181, three lock projections 182 are formed in such a way as to be passed through the two engaging holes 54 formed in the engage frame 51*a* of the connector housing 51 and be further engaged with the lock holes 166 formed in the wire push portions 67*b* of the rear holder portion 165. The second embodiment is quite the same in structure as the first embodiment, except the above-mentioned structure.

The function of the above-mentioned second embodiment of the waterproof cover MA for a connector will be described hereinbelow.

To assemble the waterproof cover MA, the lock projections 72 formed at the outer surface of the rear holder portion 165 are engaged with the engaging holes 54 of the connector housing 51, and further the lock holes 166 of the rear holder portion 165 are matched in position with the engage holes 54 of the connector housing 51. Under these conditions, the lid side cover half 82 is closed to the body side cover half 81. The closed status of the waterproof cover MA is shown in FIGS. 12 to 16.

Figure 15:
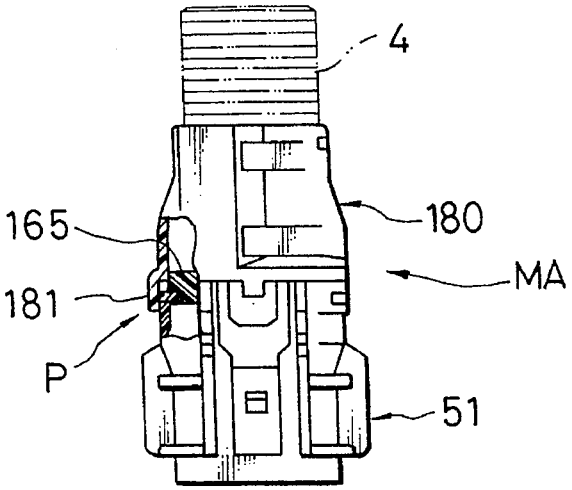
FIG. 15 is a perspective view showing the status where the second embodiment of the waterproof cover for a connector is attached to the connector housing, which is seen from a side different from that shown in FIG. 14.
Figure 16:
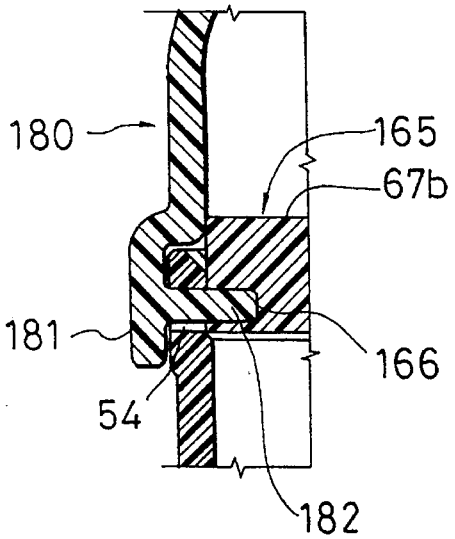
FIG. 16 is a detailed partial cross-sectional view showing the portion P shown in FIG. 15.

Under these conditions, as shown in FIGS. 15 and 16, since the projection wall 181 of the lid side cover half 82 covers the outer side of the engage frame 51 of the connector housing 51, the lock projections 182 formed in an inner surface of the projection wall 181 are passed through the engaging holes 54 formed in the engage frame 51*a* and are further engaged with the lock holes 166 formed in the rear holder portion 165, so that the lid side cover half 82 and the body side cover half 81 (e.i., the rear holder portion 165) are directly locked with the connector housing 51.

To disassembly the waterproof cover MA, the lid side cover half 82 is first opened. Then, since the lock projections 182 of the lid side cover half 82 are removed from the lock holes 166 formed in the rear holder 165 and simultaneously from the engage holes 54 formed in the engage frame 51*a* of the connector housing 51, it is possible to release the lock of the waterproof cover MA from the connector housing 51 by only opening the lid side cover half 82. In other words, since the waterproof cover MA can be removed by a single lock releasing operation between the two cover halves 81 and 82, the disassembly workability can be improved.

As described above, in the waterproof cover for a connector according to the present invention, since the rear holder portion is directly formed integral with one (the body side cover half 81) of the two cover halves of the waterproof cover portion without use of any hinge, it is possible to increase the rigidity of one of the cover halves and further the joint strength between the rear holder portion and the cover half. Moreover, two cover halves can be locked with each other by a lock mechanism, even if the hinge is broken or damaged during maintenance, it is possible to prevent the rear holder portion from being removed from the waterproof cover portion. Even if a wire extracting force is applied to the waterproof cover, since the force can be received by the lock mechanism without being applied to the hinge, it is possible to improve the durability of the hinge, that is, the life time of the waterproof cover.

Since the lid side cover half can be held between the two extension walls of the base side cover half, the unity (i.e., the rigidity) of the two cover halves can be increased under the closed condition. In addition, the locking force of the cover halves can be increased and the corrugated tube can be supported by the two cover halves stably. Further, since the cover half lock mechanism is provided inside the extension walls, it is possible to prevent the lock mechanism from being released inadvertently. That is, the lock mechanism can be released by use of only a lock releasing jig.

Lastly, since only a small force is applied to the hinge, the life of the hinge can be increased without being damaged easily.

What is claimed is:

1. A waterproof cover for a connector, which comprises:

a rear holder portion attached to a rear portion of a connector housing and holding terminals to be inserted into terminal insertion holes of the connector housing from a rear side of the connector housing; and a waterproof cover portion attached to a rear side of said rear holder portion and covering wires extending rearwardly from the terminals, said waterproof cover portion having:

a pair of first and second cover halves, a front end surface of said first cover half being formed integrally with an outer circumference of said rear holder portion so as to form an end surface plate of said first cover half along substantially the entire circumference of said first cover half;

a hinge integrally connected to each of said first and second cover halves and linking said first and second cover halves so as to be opened and closed relative to each other; and a lock mechanism locking a pair of said first and second cover halves when said two cover halves are closed.

2. A waterproof cover for a connector, which comprises:

a rear holder portion attached to a rear portion of a connector housing and holding terminals to be inserted into terminal insertion holes of the connector housing from a rear side of the connector housing; and a waterproof cover portion attached to a rear side of said rear holder portion and covering wires extending rearwardly from the terminals, said waterproof cover portion having:

a pair of first and second cover halves, a front end surface of said first cover half being formed integrally with an outer circumference of said rear holder portion so as to form an end surface plate of said first cover half along substantially the entire circumference of said first cover half;

a hinge linking said first and second cover halves so as to be opened and closed relative to each other; and a lock mechanism locking a pair of said first and second cover halves when said two cover halves are closed wherein said first cover half includes a pair of extension walls at two joint portions between said two closed cover halves so as to extend outward and receive said second cover half between the two extension walls.

3. The waterproof cover for a connector of claim 2, wherein at least one lock recessed portion forming part of said lock mechanism is formed on an inner side surface of each of the two extension walls of said first cover half.

4. The waterproof cover for a connector of claim 3, wherein at least one lock projection portion forming part of said lock mechanism in cooperation with the lock recessed portion is located on an outer side surface of each of two side walls of said second cover half.

5. The waterproof cover for a connector of claim 2, wherein at least one lock release jig insertion hole unlocking said lock mechanism is formed on a base portion of each of the two extension walls of said first cover half.

6. A waterproof cover for a connector, which comprises:

a rear holder portion attached to a rear portion of a connector housing and holding terminals to be inserted into terminal insertion holes of the connector housing from a rear side of the connector housing; and a waterproof cover portion attached to a rear side of said rear holder portion and covering wires extending rearwardly from the terminals, said waterproof cover portion having:

a pair of first and second cover halves, a front end surface of said first cover half being formed integrally with an outer circumference of said rear holder portion so as to form an end surface plate of said first cover half along substantially the entire circumference of said first cover half;

a hinge linking said first and second cover halves so as to be opened and closed relative to each other; and a lock mechanism locking a pair of said first and second cover halves when said two cover halves are closed, wherein said hinge comprises a thin resin plate formed integrally with a pair of said first and second cover halves, two ends of said hinge being joined perpendicularly with two outer side surfaces of said first and second cover halves, respectively, at a position distanced from the two joint portions between said two closed cover halves.

7. A waterproof cover for a connector, which comprises:

a rear holder portion attached to a rear portion of a connector housing and holding terminals to be inserted into terminal insertion holes of the connector housing from a rear side of the connector housing; and a waterproof cover portion attached to a rear side of said rear holder portion and covering wires extending rearwardly from the terminals, said waterproof cover portion having:

a pair of first and second cover halves, a front end surface of said first cover half being formed integrally with an outer circumference of said rear holder portion so as to form an end surface plate of said first cover half along substantially the entire circumference of said first cover half;

a hinge linking said first and second cover halves so as to be opened and closed relative to each other; and a lock mechanism locking a pair of said first and second cover halves when said two cover halves are closed, wherein said rear holder portion is of a size as to be engaged with a rear outer engaging frame of the connector housing and including a plurality of first lock projections on one side thereof and a plurality of second lock projections on the other side thereof, the first and second lock projections being engaged with engaging holes formed in the rear outer engaging frame of the connector housing when said rear holder portion is attached to the connector housing.

8. A waterproof cover for a connector, which comprises:

a rear holder portion attached to a rear portion of a connector housing and holding terminals to be inserted into terminal insertion holes of the connector housing from a rear side of the connector housing; and a waterproof cover portion attached to a rear side of said rear holder portion and covering wires extending rearwardly from the terminals, said waterproof cover portion having:

a pair of first and second cover halves, a front end surface of said first cover half being formed integrally with an outer circumference of said rear holder portion so as to form an end surface plate of said first cover half along substantially the entire circumference of said first cover half;

a hinge linking said first and second cover halves so as to be opened and closed relative to each other; and a lock mechanism locking a pair of said first and second cover halves when said two cover halves are closed, wherein said rear holder portion is of a size so as to be engaged with a rear outer engaging frame of the connector housing and includes a plurality of first lock holes on a first side thereof; said second cover half is formed with a projection wall extending frontwardly on the same first side so as to cover the rear outer engaging frame; and a plurality of lock projections are formed in an inner surface of the projection wall; and wherein when said second cover half is connected to said first cover half, the lock projections pass through engaging holes formed in the rear outer engaging frame and further engage with lock holes formed in said rear holder portion to attach said rear holder portion to the connector housing.

9. A waterproof cover for a connector, which comprises:

a rear holder portion attached to a rear portion of a connector housing and holding terminals to be inserted into terminal insertion holes of the connector housing from a rear side of the connector housing; and a waterproof cover portion attached to a rear side of said rear holder portion and covering wires extending rearward from the terminals, said waterproof cover portion having:

a pair of first and second cover halves, a front end surface of said first cover half being formed integrally with an outer circumference of said rear holder portion so as to form an end surface plate of said first cover half along substantially the entire circumference of said first cover half;

a hinge linking said first and second cover halves so as to be opened and closed relative to each other; and a lock mechanism locking a pair of said first and second cover halves when said two cover halves are closed, wherein said first and second cover halves are formed with a corrugate tube fitting groove on a rear end portion thereof, respectively.

* * * * *